US005720460A

United States Patent [19]

Watson

[11] Patent Number: 5,720,460

[45] Date of Patent: Feb. 24, 1998

[54] FIXING CLIP

[76] Inventor: Robert Baird Watson, 5 Venables Court, Berwick, Victoria 3806, Australia

[21] Appl. No.: 629,559

[22] Filed: Apr. 9, 1996

[30] Foreign Application Priority Data

Apr. 10, 1995 [AU] Australia ..... PN2263

[51] Int. Cl.[6] ..... A47F 1/10

[52] U.S. Cl. ..... 248/297.21; 52/712; 248/229.26

[58] Field of Search ..... 248/297.51, 297.21, 248/300, 274.1, 297.11, 229.16, 229.26, 297.31, 906; 52/506.06, 508, 712, 714

[56] References Cited

U.S. PATENT DOCUMENTS 2,309,420 1/1943 Taylor ..... 52/714

3,264,792 8/1966 Drazdik et al. ..... 52/508

4,570,400 2/1986 Slager et al. ..... 52/235

*Primary Examiner*—Ramon O. Ramirez

*Attorney, Agent, or Firm*—Ladas & Parry

[57] ABSTRACT

A fixing clip for mounting a furring channel onto a support structure. The clip has a base portion through which the clip is attached to the support structure. A connection portion extends from the base portion so as to outstand from the support structure when the clip is attached thereto. A furring channel is connectable to the connection portion at a selected one of a plurality of connecting positions spaced from the base portion. That in turn locates the furring channel at a predetermined distance from the support structure.

22 Claims, 2 Drawing Sheets

FIXING CLIP

BACKGROUND OF THE INVENTION

1. Field of the Invention

This invention relates generally to mounting of articles onto support structures and, in particular, to fixing clips for mounting elongate members on to the surface of a support structure. The fixing clip is applicable to mounting furring members, such as sheet metal furring channels, on to existing building wall or ceiling structures in order to provide a furring support framework for new wall or ceiling cladding. It will be convenient to hereinafter describe the invention in relation to that exemplary application, although it should be appreciated that the invention is not limited thereto.

2. Description of the Prior Art

Internal walls and ceiling structures of buildings are sometimes refurbished by applying a new wall or ceiling cladding over the existing surface. That cladding, which for example may be plasterboard, is usually secured in position overlying the existing wall or ceiling surface by means of a support framework of elongate furring members mounted on to the existing wall or ceiling surface. The framework comprises an array of furring members arranged in parallel, spaced apart relation over the existing surface. The new cladding then overlies the framework, and is attached thereto in order to secure the cladding in position. Securing of the new cladding to the framework may be achieved, for example, by means of adhesive, or fasteners such as screws and nails.

The furring members may be mounted to the existing wall or ceiling by fasteners such as bolts, screws or nails, positioned in spaced apart relation along the member. Alternatively, and particularly in the case of metal furring channels, fixing clips have been developed for that purpose. Those clips are attached on to the existing wall or ceiling with fasteners in spaced apart relation along a line on which the furring channel is to be located. The channel is then positioned over those clips and snap connected thereto in order to mount the channel on to the wall or ceiling.

In order that the new cladding presents an aesthetically pleasing smooth flat surface, free of warp and other imperfections, the furring framework is required to allow for some adjustment in the positioning of the furring members relative to the existing wall or ceiling surface. In particular, provision is generally made for "packing out" individual members or regions of those members, relative to the existing surface in order that a planar support framework is formed for the new cladding.

In the case of existing fixing clips, packing out has been achieved by fitting small packing wedges, slips or other packing pieces, as necessary, between the fixing clips and existing surface so that the furring member is built out from the existing surface at that fixing clip location. By careful selection and location of the packing pieces along individual furring members, a flat, planar furring support framework can be constructed.

This procedure is time consuming and expensive. Moreover, considerable skill and attention is required to ensure that a flat furring support framework is achieved. Lack of skill or attention results in an uneven framework which, in turn, leads to the new wall or ceiling cladding having unsightly undulations or warps.

BRIEF SUMMARY OF THE INVENTION

An object of the present invention is to alleviate these difficulties through the provision of an alternative fixing clip for furring members.

Another object of the present invention is to provide a relatively simple fixing clip enabling adjustable mounting of furring members on to the surface of a support structure.

With these objects in mind, the present invention provides a fixing clip for mounting a furring channel onto a support structure, including:

a base portion through which the clip is attached to the support structure; and, a connection portion extending from the base portion so as to outstand from the support structure when the clip is attached thereto, whereby a furring channel is connectable to the connection portion at a selected one of a plurality of connecting positions spaced from the base portion in order to locate the furring channel at a predetermined distance from the support structure.

The connection portion preferably includes a pair of connection regions. Those regions outstand from the base portion and provide the connecting positions. Thus, the connection regions preferably engagingly connect with respective flanges of the furring channel in order to connect the channel to the clip. Preferably, the connection regions are spaced apart so as to define a furring channel receiving gap therebetween. In clip use, the furring channel passes through the gap, and the connection regions extend to opposite outsides of the channel and engage with outwardly projecting flanges of the channel at a selected one of the connecting positions.

In preferred arrangement, the clip has a pair of elongate connection members providing the connection regions. Those connection members are rigid connection plates outstanding from the base portion in a common plane, at least substantially perpendicular to the base portion, in one arrangement.

Preferably, the connection portion includes clipping means for clip connecting the furring channel to the connection regions. The clipping means permit the connection of the fixing channel to the connection portion at a selected one of the connecting positions.

The clipping means preferably includes clipping recesses positioned along each of the connection members at the connecting positions. With this arrangement, corresponding recesses on each connection member are positioned to receive a respective furring channel flange therein in order to connect the furring channel to the fixing clip.

In one preferred arrangement, the clipping recesses are clipping slots. Those slots are spaced apart along side edges of the connection plates and face across the furring channel receiving gap.

The base portion preferably has a bearing surface for face-to-face bearing on a surface of the support structure. Preferably, a rigid base plate provides the base portion, that base plate having a surface forming the bearing surface.

Preferably, the bearing surface has at least two bearing surface regions. Those surface regions are relatively positioned for individually bearing on the surface of the support structure. In this way, the fixing clip can be attached to the support structure in relatively different orientations depending on which of the bearing surface regions bears on the support structure surface. That in turn varies the distance at which the connecting positions are located from the support structure.

In one preferred arrangement, the bearing surface regions are each flat and extend in planes angled relative to one another. The base portion can be attached to the support structure with a selected one of the bearing surface regions in face-to-face bearing with the support structure surface, with the other bearing surface region being angled outwardly therefrom. Selection of respective bearing surface regions attaches the fixing clip to the support structure in relatively different angular orientations. In this arrangement, the base plate has a pair of plate sections angled relative to one another, each providing a respective bearing surface region. Those plate sections are arranged in relatively fixed, side-by-side relation.

DETAILED DESCRIPTION

The following description refers to a preferred embodiment of the fixing clip of the present invention. To facilitate an understanding of the invention, reference is made in the description to the accompanying drawings where the clip is illustrated in that preferred embodiment. It is to be understood that the clip is not limited to the preferred embodiment as hereinafter described and as illustrated in the drawings.

Figure 1:
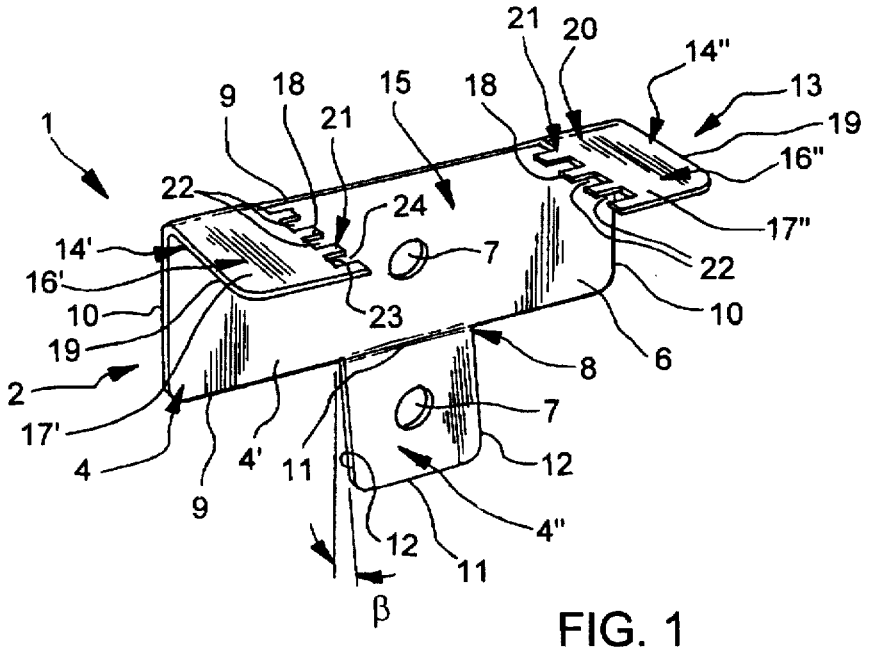
FIG. 1 is a front perspective view of a fixing clip according to a preferred embodiment of the present invention.

Referring to the drawings there is generally shown a fixing clip 1 used in mounting an elongate furring channel C on to a support structure T, such as an existing wall or ceiling structure.

Figure 2:
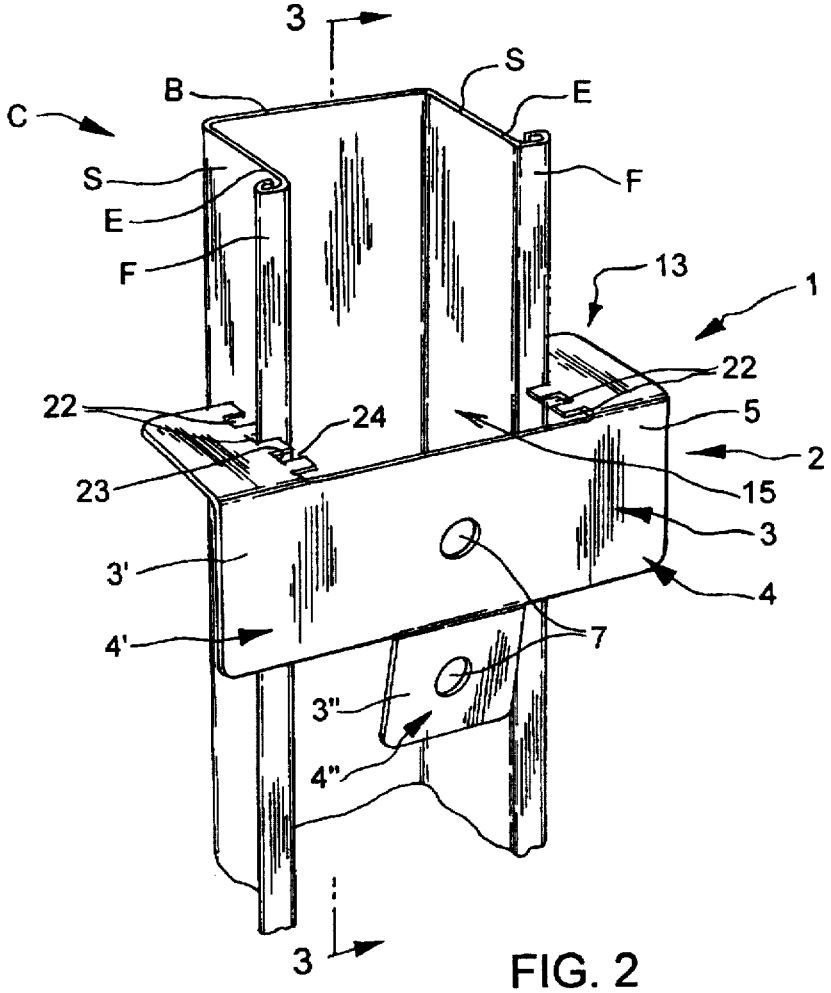
FIG. 2 is a rear perspective view of the clip of FIG. 1 with a furring channel connected thereto.
Figure 3:
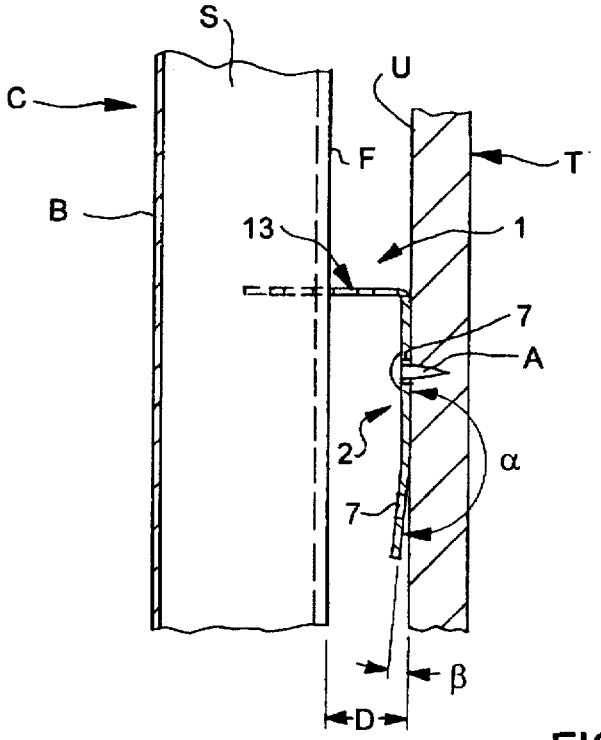
FIG. 3 is a cross sectional view of the clip and furring channel through section III—III of FIG. 2 and showing the clip in one orientation mounting the furring channel to a support structure.
Figure 4:
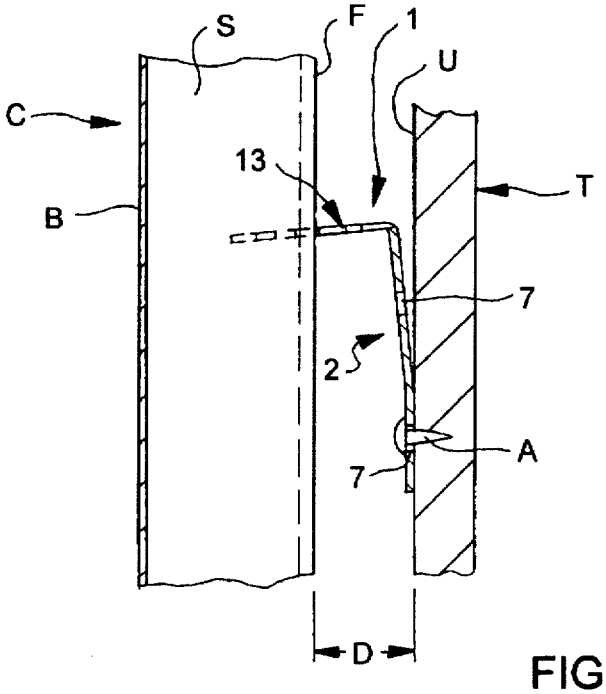
FIG. 4 is the same view of the clip and furring channel as in FIG. 3, but showing the clip in an alternative orientation mounting the furring channel to a support structure.

The furring channel C shown in FIGS. 2 to 4, and particularly suitable for use with the clip 1, is composed of sheet metal and is of generally square U-shaped cross-sectional profile. The channel C is of one piece construction, and has a bottom wall B and a pair of side walls S outstanding therefrom. In use, the channel C will be orientated so that the side walls S form spacing strips extending out from the surface U of the support structure T, while the bottom wall B provides a fastening strip spaced from the surface U and to which cladding (not shown) can be secured, as will be described in more detail hereinafter.

This furring channel C also has a pair of elongate flanges F extending along respective side walls S and projecting laterally therefrom. With one particularly suitable furring channel C (as shown), the flanges F extend along free edges E of the side walls S remote from the bottom wall B, and project at least outwardly therefrom. The flanges F may also project inwardly, on one particular channel C (not shown). Those flanges F are co-planar, and extend parallel with the plane of the bottom wall B, in this particular channel C.

It will be convenient to hereinafter further describe the fixing clip 1 with reference to this particular furring channel C. However, as will be appreciated by those skilled in this art, the fixing clip 1 is not limited to use with such a channel C, and that other furring members may be equally suited for use with the clip 1 of the present invention.

The fixing clip 1 has a base portion 2 through which the clip 1 is attached to the support structure T. The base portion 2 is of generally planar configuration and, in use, will be positioned between the support structure surface U and the furring channel C. Thus, the furring channel C will generally overlie the base portion 2 during use of the fixing clip 1.

The base portion 2 has a generally flat bearing surface 3 for face-to-face bearing on the surface U of the support structure T, when the base portion 2 is attached thereto, as shown in FIGS. 3 and 4.

The base portion 2 is provided by a rigid base plate 4. That plate 4 has opposed surfaces 5,6, one of which forms the bearing surface 3.

The base portion 2 can be attached to the support structure T in any suitable manner. In this embodiment, that attachment is achieved with fasteners A, such as bolts, screws or nails. To that end, the base portion 2 is provided with at least one attachment hole 7 in the base plate 4, the holes 7 being suitable for receiving a fastener A therethrough for attaching the base plate 4 to the support structure T in order to attach the clip 1 thereto.

The bearing surface 3 of the base portion 2 has at least two bearing regions 3', 3", relatively positioned for individually bearing on the surface U of the support structure T. As will become more apparent hereinafter, the individual bearing surface region 3', 3" selected to bear on the support structure surface U will depend on the required positioning of the furring channel C, relative to the structure T, in order to achieve a desired planar support framework for new wall or ceiling cladding.

Each of the bearing regions 3', 3" are flat, but extend in planes angled relative to one another. In this embodiment the bearing regions 3', 3" are angled away from one another, so that the angle $\alpha$ extending between the planes of those regions is greater than 180°. With this arrangement, the base portion 2 can be attached to the support structure T with a selected one of the bearing regions 3', 3" in face-to-face bearing with the structure surface U. With one bearing region 3', 3" bearing on the structure surface U, the other bearing region 3', 3" will be angled outwardly therefrom.

The base plate 4 providing the base portion 2 has two rigid plate sections 4', 4". in this embodiment, those sections 4', 4" are angled relative to one another so as to provide the angled bearing surface regions 3', 3". Those plate sections 4', 4" (as shown) are arranged in fixed, side-by-side relation, and have a common transitional edge 8 through which the section planes extend at an angle to one another. Alternatively (not shown), those plate sections 4', 4" may be in fixed, spaced apart relation, in which case the sections 4', 4" have separate parallel edges through which the section planes extend.

The base plate 4 has a generally square or rectangular primary plate section 4' having a pair of side edges 9, one of which forms the transitional edge 8, and a pair of end edges 10. The base plate 4 also has a generally square or rectangular secondary plate section 4" having a pair of side edges 11, one of which forms the transitional edge 8, and a pair of end edges 12. The secondary plate section 4" is angled about the transitional edge 8, relative to the primary plate section 4', in a direction away from the bearing region 3' of the primary plate section 4'. Thus, with the bearing region 3' of the primary plate section 4' bearing face-to-face on the support structure T (as shown in FIG. 3), the secondary plate section 4" is angled outwardly away from the support structure T.

The plate sections 4', 4" are sized relative to the furring channel C so that, in use, the primary plate section 4' projects longitudinally outwardly beyond the side walls S and flanges F of the channel C, while the secondary plate section 4" does not project beyond the side walls S but rather is confined between those walls S. With this arrangement, when the primary plate section 4' is in face-to-face relation with the support structure T, the secondary plate section 4" is able as necessary to project between the side walls S into the furring channel C. Thus, the projecting secondary plate section 4" does not interfere with the furring channel positioning.

In this embodiment, the primary plate section 4' is rectangular and relatively large, white the secondary plate section 4" is square and relatively small. The secondary plate section 4" is positioned centrally along the primary plate section 4', thereby forming a generally T-shaped base plate 4.

The plate sections 4', 4" extend at an angle β to one another of less than about 5°. In this embodiment, that angle is about 2°. in any event, the angle β is selected according to the desired angular shift of the clip 1, relative to the support structure T, that will be achieved by positioning a selected bearing surface region 3', 3" in bearing engagement with the support structure surface U, as shown in FIGS. 3 and 4.

The base plate 4 is provided with at least one attachment hole 7 in each plate section 4', 4". In this way, a fastener A can be passed through that attachment hole 7 in the base plate section 4', 4" selected to be attached to the support structure T, as shown in FIGS. 3 and 4.

The fixing clip 1 also includes a connection portion 13 extending from the base portion 2 so as to outstand from the support structure T when the clip 1 is attached thereto. As shown in FIGS. 2 to 4, the furring channel C is connectable to the connection region 13 in order to mount the channel C to the structure T. The connection portion 13 includes a pair of connection regions 14', 14". Those connection regions 14', 14" outstand from the base portion 2 so as to engagingly connect with respective flanges F of the furring channel C, in order to connect the channel C to the clip 1. The connection regions 14', 14" are spaced apart so as to define a gap 15 therebetween through which the furring channel C passes. With this arrangement, the connection regions 14', 14" extend to each outside of the channel C, and engage with the outwardly projecting flanges F.

The connection regions 14', 14" are provided by elongate connection members 16', 16" respectively, outstanding from the base plate 4. Those members 16', 16" outstand from the primary plate section 4', at or adjacent the side edge 9 thereof opposite the transitional edge 8. The connection members 16', 16" are located adjacent respective end edges 10.

In this embodiment, the connection members 16', 16" are rigid connection plates 17', 17". Those plates 17', 17" extend in a common plane, at least substantially perpendicular to the plane of the primary base plate section 4'.

Each plate 17', 17" has a pair of longitudinal side edges 18 and a pair of lateral end edges 19. Moreover, those plates 17', 17" are arranged, each with one end edge 19 fixed along that side edge 9 of the base plate section 4' opposite the transitional edge 8. With this arrangement, opposite side edges 18 of the connection plates 17', 17" face one another across the furring channel receiving gap 15.

The connection portion 13 includes clipping means 20 for clip connecting the furring channel C to the connection regions 14', 14", and thus to the fixing clip 1. That clipping means 20 permits the connection of the furring channel C to the connection portion 13 at a selected one of a plurality of connecting positions along the connection regions 14', 14". Those connecting positions are at different distances d from the base portion 3, so that the distance D of the connecting positions and thus the furring channel C from the support structure surface U can be selectively varied depending on the connecting position adopted.

The clipping means 20 is located on each of the connection members 16', 16", and cooperate with respective flanges F of the furring channel C to achieve connection. To that end, the clipping means 20 includes clipping recesses 21 positioned along the connection members 16', 16", corresponding recesses 21 on each connection member 16', 16" being positioned to receive a respective furring channel flange F therein in order to connect the furring channel C. Thus, clipping recesses 21 on each connection member 16', 16" are arranged in aligned pairs at different distances d from the base portion 3.

The clipping recesses 21 are provided by clipping slots 22 spaced along the connection plates 17', 17". Those slots 22 are formed in the opposite side edges 18 of the connection plates 17', 17" facing across the furring channel receiving gap 15.

The slots 22 are spaced apart along the connection plates 17', 17", commencing immediately adjacent the primary base plate section 4'. Any suitable slot spacing may be selected, although in the exemplary application of the clip 1, a centre-to-centre spacing of about 4 mm is appropriate. That will allow positioning of the furring channel C at incrementally varying distances D of 4 mm from the support structure surface U.

Those incremental distances D can be reduced through conjunctional selection of the connection slots 22 and base plate section 4', 4" that is attached to the support structure T, as shown in FIGS. 3 and 4. Thus, where the clipping slots 22 are spaced apart about 4 mm, distances D from the support structure surface U can be halved to increments of about 2 mm through appropriate relative angling of the base plate sections 4', 4". As a result, attaching the secondary base plate section 4" to the support structure T (as shown in FIG. 4) will shift all of the slots an incremental distance of 2 mm from the support structure surface U when compared with attaching the primary base plate section 4' to the support structure T (as shown in FIG. 3). By alternating selection of the base plate sections 4', 4" at each successive slot 22 from the base plate 4, the distance D of the slots 22 from the support structure surface U can be incrementally increased by 2 mm.

In the exemplary application of the fixing clip 1, a series of four clipping slots 22 are spaced apart along each connection plate 17', 17", although it will be appreciated that other slot numbers may be adopted.

The clipping slots 22 are shaped and sized so that the furring channel flanges F are interferingly engaged therein, in order to firmly secure the channel C. In this embodiment, the slots 22 are of a shape and size that requires the side walls S of the furring channel C to be resiliently deflected inwardly toward one another in order to position the channel C in the receiving gap 15 between the connection plates 17', 17" and locate the flanges F adjacent selected clipping slots 22. Upon release, the deflected side walls S resiliently return outwardly, causing the flanges F to move into the selected slots 22. However, the shape and size of those slots 22 are such that the flanges F interferingly engage against end faces 23 of the selected slots 22, with some deflection return force remaining in the side walls S. In this embodiment, the side walls S of the channel C are manually deflectable, release of the deflected side walls S tending to cause the flanges F to snap return into the selected clipping slots 22.

The clipping slots 22 are generally rectangular in shape (as shown). However, other shapes are contemplated and, in particular, the end face 23 of the slots 22 may be curved or otherwise profiled to correspond with the channel flange F shape so that the engaging flanges F are neatly received thereagainst. Moreover, in one embodiment (not shown), the slots 22 may be shaped so as to provide a narrowed or restricted opening 24 in order to inhibit accidental flange removal therefrom.

The fixing clip 1 is constructed in any suitable manner from any appropriate material, having regard to its intended application. In this embodiment of the clip 1 intended for the exemplary application, the clip 1 is formed in one piece from sheet metal, such as galvanised steel sheet. The clip 1 is stamped, cut and folded into shape as necessary.

Use of a fixing clip 1, according to this preferred embodiment of the present invention, in mounting a furring channel C on to an existing support wall surface U will now be outlined.

Furring channels C are attached to an existing wall surface U in an array so as to form a furring channel framework (not shown) for supporting a new wall cladding (not shown). Typically, the channels C are mounted vertically on the existing wall surface U at about 600 mm centre-to-centre spacing. The clips 1 used to so mount the channels C are attached along channel lines at about 1200 mm spacings.

Each fixing clip 1 in turn is attached to the existing wall surface U. That is achieved by manually placing each clip 1 in position on a channel line and adjacent a plumb line lying on or parallel to a plane proposed to contain the bottom wall B of the furring channels C. With the clip 1 manually held in that position, it can be rocked so that the bearing surface regions 3', 3" alternatively bear on the wall surface U. At each rocked position, as shown in FIGS. 3 and 4 respectively, the clipping slots 22 can be checked against the plumb line to determine in which clip position a slot 22 is located closest to the distance D from the wall surface U that will enable a furring channel C to be mounted in a position that will place the bottom wall B on the selected plane.

The positioned clip 1 is then fastened with fasteners A, such as bolts or nails, passing through an attachment hole 7 in the base plate 4. The fastener A will pass through the hole 7 in the bearing plate section 4', 4" that finally bears on the wall surface U.

With a line of fixing clips 1 attached to the existing wall surface U, a furring channel C can then be connected to those clips 1. In the region of each clip 1, in turn, the channel C is manually squeezed so as to deflect the side walls S inwardly toward one another, allowing the channel C to enter the gap 15 between the connection plates 17', 17". The channel C is manoeuvred within that gap 15 until the channel flanges F align with the previously selected clipping slots 22. In that location, the channel side walls S are released, allowing them to return deflect, and the flanges F to snap into those slots 22 for interfering engagement therewith. Connection of the channel C to each clip 1 firmly and positively mounts the channel C on to the wall in a position at which the bottom wall B lies on the desired framework plane.

Each line of fixing clips 1 is similarly attached to the existing wall surface U, and furring channels C connected to those clips 1, in order to complete the furring channel framework.

The fixing clip of the present invention enables easy yet accurate mounting of furring members on to the surface of support structures. That can be achieved without a high degree of skill on the part of the installer. As a result, there is a reduced likelihood, when compared with prior arrangements, of the furring members being mounted unevenly or otherwise incorrectly positioned relative to the support structure.

The fixing clip of the present invention is of simple construction and, accordingly, of low capital cost.

Finally, it is to be appreciated that various modifications and/or additions may be made to the fixing clip without departing from the ambit of the present invention as defined in the claims appended hereto.

What I claim is:

1. A fixing clip for mounting a furring channel onto a support structure, comprising:

a base portion through which the clip is attached to the support structure, the base portion having at least two bearing surface regions relatively positioned for individual face-to-face bearing on a surface of the support structure; and, a connection portion extending from the base portion so as to outstand from the support structure when the clip is attached thereto, the connection portion having a plurality of connecting positions spaced at different distances from the base portion;

whereby, the fixing clip being attachable to the support structure in relatively different orientations depending on which of the bearing surface regions bears on the surface of the support structure thereby to vary the distances at which the connecting positions are located from the support structure, and a furring channel is connectable to the connection portion at a selected one of the connecting positions in order to locate the furring channel at a predetermined distance from the support structure.

2. A fixing clip as claimed in claim 1, wherein the connection portion includes a pair of connection regions outstanding from the base portion and providing the connecting positions so as to engagingly connect with respective flanges of the furring channel in order to connect the channel to the clip.

3. A fixing clip as claimed in claim 2, wherein the connection regions are spaced apart so as to define a furring channel receiving gap therebetween through which the furring channel passes in clip use, the connection regions extending to opposite outsides of the channel and engaging with outwardly projecting flanges of the channel at a selected one of the connecting positions.

4. A fixing clip as claimed in claim 2, including a pair of elongate connection members respectively providing the connection regions, the connection members outstanding from the base portion.

5. A fixing clip as claimed in claim 4, wherein the connection members are rigid connection plates extending in a common plane, at least substantially perpendicular to the base portion.

6. A fixing clip as claimed in claim 5, wherein the connection portion includes clipping means for clip connecting the furring channel to the connection regions, the clipping means permitting the connection of the fixing channel to the connection portion at a selected one of the connecting positions.

7. A fixing clip as claimed in claim 6, wherein the clipping means includes clipping recesses positioned along each of the connection members at the connecting positions, corresponding recesses on each connection member being positioned to receive a respective furring channel flange therein in order to connect the furring channel to the fixing clip.

8. A fixing clip as claimed in claim 7, wherein the clipping recesses are clipping slots spaced apart along side edges of the connection plates and facing across the furring channel receiving gap.

9. A fixing clip as claimed in claim 8, wherein each clipping slot has an end opening into the furring channel receiving gap through which a respective furring channel flange is receivable, the end having a restricted opening into the slot in order to inhibit flange removal therefrom.

10. A fixing clip as claimed in claim 1, wherein the bearing surface regions extend at an angle to one another of less than about 5°.

11. A fixing clip as claimed in claim 1, and including a rigid base plate providing the base portion, the base plate having a surface providing the bearing surface regions.

12. A fixing clip as claimed in claim 11, wherein the bearing surface regions are each flat and extend in planes angled relative to one another, whereby the base portion can be attached to the support structure with a selected one of the bearing surface regions in face-to-face bearing with the support structure surface and with the other bearing surface region being angled outwardly therefrom, selection of respective bearing surface regions attaching the fixing clip to the support structure in relatively different angular orientations and thereby varying the distances at which the connecting positions are located from the support structure.

13. A fixing clip as claimed in claim 12, wherein the base plate has a pair of plate sections angled relative to one another, and each providing a respective bearing surface region, the plate sections being arranged in relatively fixed, side-by-side relation.

14. A fixing clip as claimed in claim 13, wherein the plate sections are relatively arranged so that the base plate is generally T-shaped.

15. A fixing clip for mounting a furring channel onto a support structure, comprising:

a base portion through which the clip is attached to the support structure; and, a connection portion on the base portion, the connection portion having a pair of connection regions extending from the base portion so as to outstand from the support structure when the clip is attached thereto, the connection regions being spaced apart so as to define a furring channel receiving gap therebetween through which the furring channel passes in clip use, and the connection portion including clipping recesses spaced apart along each of the connection regions at different distances from the base portion and facing across the furring channel receiving gap;

whereby, in clip use, a furring channel passes through the furring channel receiving gap and a pair of outwardly projecting flanges of the furring channel are receivingly engaged in selected respective clipping recesses in each of the connection regions in order to locate the furring channel at a predetermined distance from the support structure.

16. A fixing clip as claimed in claim 15, including a pair of rigid elongate connection plates providing the connection regions, the connection plates extending in a common plane and wherein the clipping recesses are clipping slots spaced apart along side edges of the connection plates.

17. A fixing clip as claimed in claim 16, wherein the base portion has a bearing surface for face-to-face bearing on a surface of the support structure, the bearing surface having at least two bearing surface regions, relatively positioned for individually bearing on the surface of the support structure, the fixing clip being attached to the support structure in relatively different orientations depending on which of the bearing surface regions bears on the support structure surface thereby to vary the distance at which the dipping slots are located from the support structure.

18. A fixing clip as claimed in claim 19, and including a rigid base plate having a pair of prate sections angled relative to one another, each plate section providing a respective flat bearing surface region, whereby a selected one of the base plate sections can be attached to the support structure with a respective bearing surface region in face-to-face bearing with the support structure surface and with the other base plate section being angled outwardly therefrom, selection of respective base plate sections attaching the fixing clip to the support structure in relatively different angular orientations and thereby varying the distance at which the dipping slots are located from the support structure.

19. A fixing clip for mounting a furring channel onto a support structure, comprising:

a base portion through which the clip is attached to the support structure, the base portion having at least two bearing surface regions relatively positioned for individual face-to-face bearing on a surface of the support structure; and, a connection portion extending from the base portion so as to outstand from the support structure when the clip is attached thereto, the connection portion including dipping means through which a furring channel is connectable to the connection portion at a selected one of a plurality of connecting positions spaced from the base portion in order to locate the furring channel at a predetermined distance from the support structure, the fixing clip being attached to the support structure in relatively different orientations depending on which of the bearing surface regions bears on the support structure surface thereby to vary the distances at which the connecting positions are located from the support structure.

20. A fixing clip as claimed in claim 19, wherein the connection portion includes a pair of connection regions outstanding from the base portion, and the dipping means includes clipping recesses positioned along each of the connection regions providing the connecting positions, corresponding recesses on each connection region being positioned to receive a respective furring channel flange therein in order to connect the channel to the clip.

21. A fixing clip as claimed in claim 20, including a pair of rigid elongate connection plates providing the connection regions, the connection plates extending in a common plate and being spaced apart so as to define a furring channel receiving gap therebetween through which the furring channel passes in clip use, the clipping recesses being clipping slots spaced apart along side edges of the connection plates and facing across the furring channel receiving gap, whereby in clip use the connection plates extend to opposite outsides of the channel and corresponding clipping slots receivingly engage with outwardly projecting flanges of the channel.

22. A fixing clip as claimed in claim 19, and including a rigid base plate having a pair of plate sections angled relative to one another, each plate section providing a respective flat bearing surface region, whereby a selected one of the base plate sections can be attached to the support structure with a respective bearing surface region in face-to-face bearing with the support structure surface and with the other base plate section being angled outwardly therefrom, selection of respective base plate sections attaching the fixing clip to the support structure in relatively different angular orientations and thereby varying the distances at which the connecting positions are located from the support structure.

* * * * *